US009989925B2

(12) United States Patent
Wautier et al.

(10) Patent No.: US 9,989,925 B2
(45) Date of Patent: Jun. 5, 2018

(54) ANALOG TYPE WATCH AND TIME SET METHOD

(71) Applicant: WITHINGS, Issy les Moulineaux (FR)

(72) Inventors: Edouard Wautier, Levallois (FR); Rachid Saadi, Plaisir (FR); Cédric Hutchings, Issy les Moulineaux (FR)

(73) Assignee: WITHINGS, Issy les Moulineaux (FR)

( * ) Notice: Subject to any disclaimer, the term of this patent is extended or adjusted under 35 U.S.C. 154(b) by 0 days. days.

(21) Appl. No.: 14/621,111

(22) Filed: Feb. 12, 2015

(65) Prior Publication Data

US 2016/0238996 A1 Aug. 18, 2016

(51) Int. Cl.
*G04C 3/00* (2006.01)
*G04R 20/30* (2013.01)

(52) U.S. Cl.
CPC ..... *G04C 3/001* (2013.01); *G04R 20/30* (2013.01)

(58) Field of Classification Search
CPC ..... G04R 20/26; G04R 20/28; G04R 20/30; G04G 5/00; G04G 5/04; G04G 5/043; G04G 7/00; G04G 9/0064; G04G 17/08; G04G 17/083; G04G 21/08; G04C 3/001; G04C 9/00; G04C 3/00; G04C 9/02; G04C 3/146
See application file for complete search history.

(56) References Cited

U.S. PATENT DOCUMENTS 4,470,706 A * 9/1984 Nishimura ..... G04C 3/14 368/251
4,474,480 A * 10/1984 Kato ..... G04C 3/00 368/223
4,645,357 A * 2/1987 Allgaier ..... G04C 13/03 368/184
4,650,344 A * 3/1987 Allgaier ..... G04C 9/02 368/47
5,119,349 A * 6/1992 Muto ..... G04C 17/00 368/107
5,299,177 A 3/1994 Koch
6,965,543 B1 * 11/2005 Shum ..... G04C 3/146 368/47
7,167,417 B2 * 1/2007 Akahane ..... G04C 9/02 368/155

(Continued)

*Primary Examiner* — Sean Kayes
(74) *Attorney, Agent, or Firm* — Miller, Matthias & Hull LLP

(57) ABSTRACT

An interaction method between a graphic tactile device such as a smartphone and a timepiece having at least two analog-type physical pointers is disclosed. Each of the pointers is controlled independently by a stepper motor and referenced relative to a ref-position. The timepiece comprises a control unit configured to handle time count and to control stepper motors. The smartphone has a value setting interface, and the timepiece and the smartphone communicate through a wireless remote short-range communication link. The method comprises the steps of initiating a calibration procedure, causing the minute pointer to be moved to the ref-position via the value setting interface, causing the hour pointer to be moved to the ref-position via the value setting interface, and ending the calibration procedure, and return to a normal time display, Thereby, starting from an initial unknown pointer positions, the control unit of the timepiece can accurately know the positions of pointers.

9 Claims, 3 Drawing Sheets

(56) References Cited

U.S. PATENT DOCUMENTS 7,946,758 B2 * 5/2011 Mooring ..... G04B 37/005 368/276
8,467,271 B2 * 6/2013 Hirokawa ..... G04B 19/247 368/37
8,588,033 B2 * 11/2013 Pozzo Di Borgo .... G04C 3/002 345/173
9,192,326 B2 * 11/2015 Kahn ..... G04G 13/026
2002/0115478 A1 * 8/2002 Fujisawa ..... H04M 1/6505 455/567
2002/0172095 A1 * 11/2002 Pandipati ..... G04R 20/00 368/47
2003/0058744 A1 * 3/2003 Calace ..... A63B 71/0605 368/109
2004/0014506 A1 * 1/2004 Kemppinen ..... A45C 11/24 455/575.1
2004/0052161 A1 * 3/2004 Liao ..... G04G 21/00 368/47
2005/0105401 A1 * 5/2005 Akahane ..... G04C 9/02 368/187
2008/0186808 A1 * 8/2008 Lee ..... G04G 5/04 368/10
2009/0189809 A1 * 7/2009 Baba ..... G01S 1/047 342/357.57
2009/0196124 A1 * 8/2009 Mooring ..... G04B 37/005 368/204
2010/0087230 A1 * 4/2010 Peh ..... G06F 3/04817 455/566
2010/0112964 A1 * 5/2010 Yi ..... G04G 21/04 455/90.3
2010/0295805 A1 * 11/2010 Shin ..... G06F 3/04883 345/173
2011/0193878 A1 * 8/2011 Seo ..... H04M 1/72544 345/619
2013/0018284 A1 * 1/2013 Kahn ..... G04G 13/026 600/595
2013/0064045 A1 * 3/2013 Essery ..... H04W 88/02 368/47
2013/0201802 A1 * 8/2013 Born ..... G04B 27/007 368/185
2013/0272099 A1 * 10/2013 Yang ..... G04R 40/00 368/13
2014/0098648 A1 * 4/2014 Breckman ..... G04B 45/00 368/228
2014/0171055 A1 * 6/2014 Oshita ..... H04W 4/12 455/418
2015/0074594 A1 * 3/2015 Shin ..... G06F 3/04883 715/784

* cited by examiner

ANALOG TYPE WATCH AND TIME SET METHOD

FIELD OF THE DISCLOSURE

The present invention concerns analog-type watches and systems and methods of time setting of such watches using a smartphone interaction.

BACKGROUND OF THE DISCLOSURE

In the known art, analog-type watches comprise a button available to the user for time setting operation. The time setting button allows to move the pointers (also called 'hands'), namely the hour pointer and the minute pointer. The time setting operation usually requires to pull the time setting button which may involve damage to the nails of the user. After effective time setting, the time setting button must be pushed back into the stowed position. The operation of pushing back the time setting button may also involve a small inadvertent turn of the time setting button, and the resulting setting may thus be not accurate.

There is therefore a general need to render more reliable and also simplify systems and methods of time setting of such analog-type watches.

Also, most known analog-type watches have a reduction gear linking the hour and minute pointers. A way to simplify the structure of analog-type watches is to decouple hour and minute pointers. In this configuration, each of hour and minute pointers are controlled independently via a stepper motor, as disclosed in document U.S. Pat. No. 5,299,177. This simplifies the mechanic arrangement and allows enhanced functionalities but requires more complex electronic control.

In this configuration, however, the risk of inadvertent leap of one of the pointer is increased, for example in case of shock, electromagnetic interference or in case of low power supply. When the pointers are controlled in open loop mode, (i.e. without any position sensing feedback, only with a software zero-position), this may lead to a deviation between the assumed position (from the watch controller standpoint) and the actual position of the pointer(s). This situation requires a re-calibration of the pointer position with regard to a reference position (usually 12:00).

Also, when the power supply has been interrupted, the controller may have lost the knowledge of the positions of the pointers.

Finally, at first power up of the controller of the watch, the positions of the pointers are, in the absence any position sensing device, completely unknown.

It is to be noted that each of the independently controlled pointer has, at least for calibration purposes, a particular reference position, called in the present disclosure 'ref-position'.

Therefore, there is a need to bring new solutions to time setting and calibration of pointers in analog-type watches with pointer independent control.

SUMMARY OF THE DISCLOSURE

According to a first aspect of the present invention, it is disclosed an interaction method between on the one hand a smartphone and on the other hand a timepiece having at least two analog-type physical pointers, each of the pointers being controlled independently by a stepper motor and each referenced respectively relative to a first and second ref-position, the timepiece comprising a control unit configured to handle time count and to control stepper motors, the timepiece being deprived of any time set button/actuator, the smartphone having a value setting interface, the timepiece and the smartphone being able to be in communication through a wireless remote short-range communication link, the method comprising the steps:

S1—initiating a calibration procedure, initiated on the smartphone or by the timepiece, S2—Causing the minute pointer to be moved to the first ref-position via the value setting interface 4 on the smartphone, S3—Causing the hour pointer to be moved to the second ref-position via the value setting interface 4 on the smartphone, S4—ending the calibration procedure, and return to a normal time display, Thereby, starting from a state in which the actual pointers positions initial are unknown, the control unit of the timepiece can be caused to accurately know the positions of pointers, operation which is also called 'calibration of pointers'.

According to an embodiment, the value setting interface is a touch graphic interface formed as a wheel graphic object, and at step S2 and/or step S3, an angular movement of the pointer is performed in response to a consistent drag travel on the wheel graphic object by the finger of a user. Thereby, there is provided an intuitive and self-explaining pointer calibration.

It should be understood that, instead of a smartphone, the device having the above mentioned "value setting interface" can also be more generally a graphic tactile device (such as a tablet, a phablet, a PDA, a laptop computer, or any like wireless-and-graphic enabled device).

In various embodiments of the invention, one may possibly have recourse in addition to one and/or other of the arrangements which can be found in the dependent claims.

According to a second aspect of the present invention, it is a timepiece having at least two analog-type pointers, each of the pointers being controlled independently by a stepper motor and referenced relative to a ref-position, said timepiece being deprived of time set button/actuator, said timepiece being able to communicate through a wireless short-range communication, with a remote device such a smartphone handled by a user who can see the timepiece, said timepiece being configured to, under a calibration procedure:

move the minute pointer upon receiving motion controls from the remote device, enabling the user to cause the pointer to move toward the ref-position, move the hour pointer upon receiving motion controls from the remote device, enabling the user to cause the pointer to move toward the ref-position, whereby the pointers calibration operation can be performed through an interaction with the remote device.

Since there is no time setting button, a good water-tightness level for the watch is easier to achieve.

BRIEF DESCRIPTION OF THE DRAWINGS

Other features and advantages of the invention appear from the following detailed description of one of its embodiments, given by way of non-limiting example, and with reference to the accompanying drawings, in which.

DETAILED DESCRIPTION OF THE DISCLOSURE

In the figures, the same references denote identical or similar elements.

Figure 1:
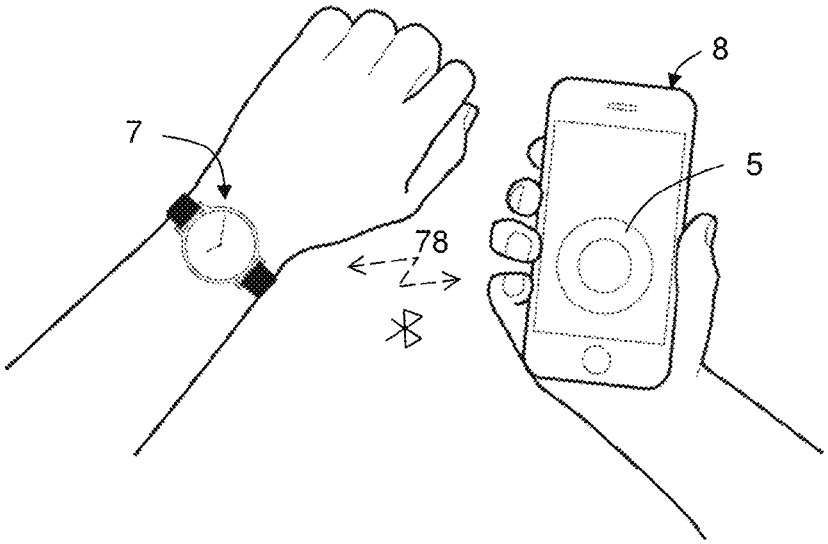
FIG. 1 illustrates a wristwatch and a smartphone involved in an interaction method according an exemplary embodiment of the present invention.

FIG. 1 shows a wristwatch 7 and a smartphone 8 configured to interact with each other to carry out a calibration method relative to the positions of the pointers.

The wristwatch 7 and the smartphone 8 are able to be in communication through a wireless short-range communication link 78, preferably Bluetooth™ interface. However, instead of Bluetooth™, any wireless remote short-range communication link can be used.

Figure 2:
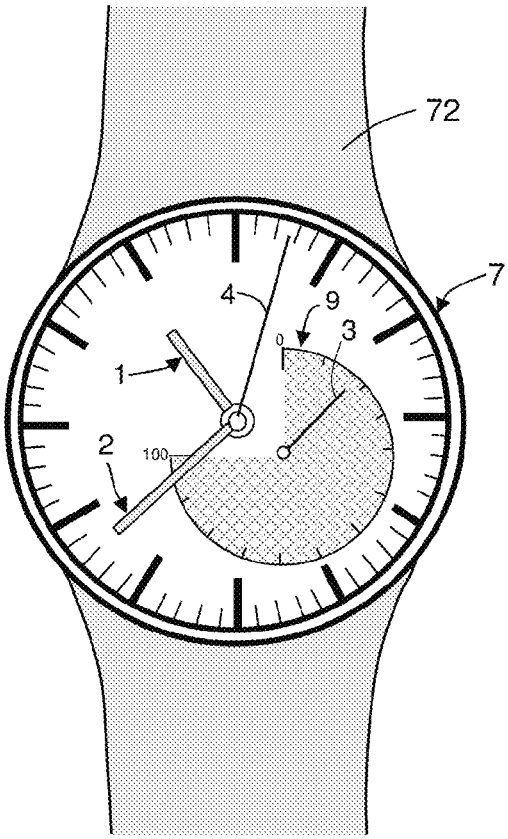
FIG. 2 shows a front schematic view of a watch according to an exemplary embodiment of the invention.
Figure 3A:
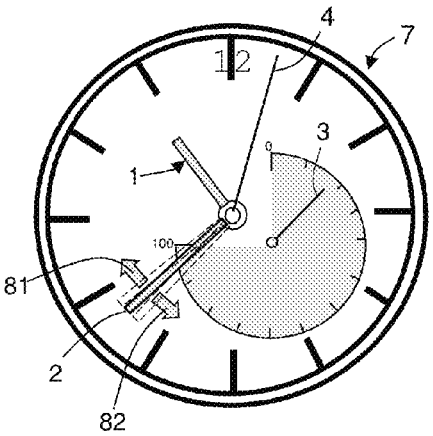
FIGS. 3A, 3B, 3C and 3D illustrate various stages of the method according an exemplary embodiment of the present invention.
Figure 3B:
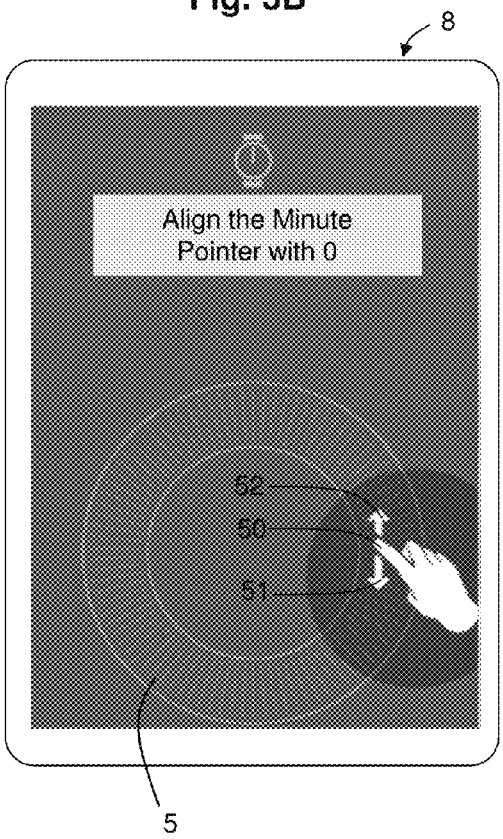
Figure 3C:
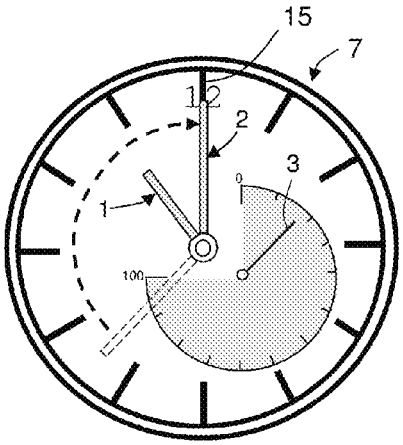
Figure 3D:
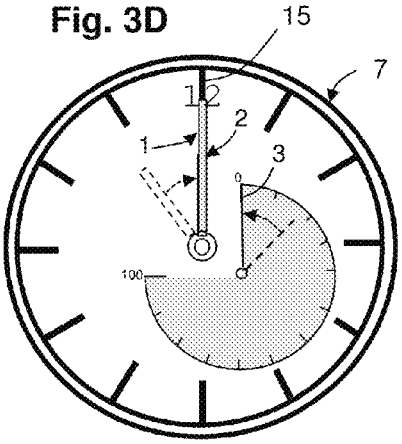
Figure 4:
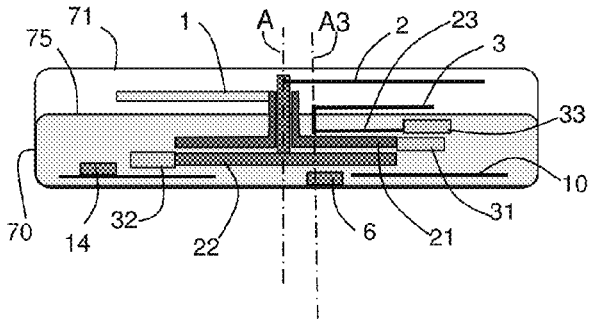
FIG. 4 is a side sectional view of the watch of FIG. 2, FIGS. 5A, 5B illustrate various alternatives to the wheel-type value setting interface.

As shown in FIGS. 2 and 4, the wrist watch 7 has several pointers (1,2,4), thereby forming an analog-type watch. It should be noted that each pointer is a physical pointer (also called 'hand') formed as a flat thin strip of rigid material fixed to a hub able to rotate around an axis A.

For time indication in the shown example, there are provided basically two pointers, namely a hour pointer 1 and a minute pointer 2. In the shown example, these two time pointers are arranged coaxially, as conventionally known, and are configured to rotate around a central axis A. Optionally, there may be provided another pointer 4 for indicating the seconds.

It is important to state that the present disclosure can also be applied to other type of analog-type timepieces, for example a wall clock. According the present disclosure, the user of the smartphone (generally speaking a graphic tactile device) can see the timepiece, in particular the position of the pointers.

In the shown example, the watch comprises a housing 70 attached to a wrist strap 72, and a transparent cover 71 above the pointers, as known per se. In the present example, the assembly comprising the housing 70 and the cover 71 forms a watertight assembly, so the user can swim with the watch. According to an embodiment, the watch exhibits a watertightness level of at least IP56, and even at least IP68.

Besides the two pointers 1,2 already commented, the exemplified watch 7 includes another auxiliary analog-type indicator 9 with a specific pointer 3. This first indicator 9 is configured to display the daily number of steps done by the user, for example between 0% and 100% of a daily target, like the watch "Activité™" marketed by the applicant.

Alternately, the exemplified watch 7 can include more than one other auxiliary analog-type indicators.

Pointer 3 is rotatably mounted around axis A3. Pointer 3 is movable across a range of 270° in the shown example.

The first auxiliary indicator 3 is configured to display the daily number of steps done by the user, but another indicator can also be selected to be displayed, like the current atmospheric pressure, the altitude, the temperature, etc. . . . .

Inside the housing 70 are enclosed the following items:

an electronic board (PCB) 10, with a controller 14, and an oscillator, a first stepper motor 31 to drive the first pointer namely the hour pointer 1, via a disklike plate 21 a second stepper motor 32 to drive the second pointer namely the minute pointer, via a disklike plate 22, a third stepper motor 33 to drive the third, pointer, via a disk-portion-like plate 23, if present, another stepper motor (not shown) for the seconds pointer, a dial 75 with visible marks, a battery, either conventional or rechargeable, a vibrator, to generate vibrations intended to be sensed by the user, forming user feedback, an accelerometer, to sense the accelerations particularly the accelerations induced by the movements of the user, and also sense a 'tap' action of the user on the watch, biological sensor(s) 6, like optical sensor using photoplethysmography, or piezoelectric sensors, or temperature sensor, or else, a Bluetooth™ wireless coupler, configured to establish a wireless communication 78 with another device like a smartphone, or other devices, electroluminescent diodes (Leds), to 'select' optically pictograms, or to serve as general backlight.

Of course, various other sensors can be envisaged like environmental sensors, pollutants sensors, pressure sensor, light intensity sensor, etc. . . . .

Instead of Bluetooth™, any wireless remote short-range communication link can be used.

Each of the pointers is independently controlled by one stepper motor (31,32,33), via a disk-like plate, in either direction (clockwise or counterclockwise). Each pointer is referenced relative to a reference position, also known as a ref-position, which is formed as a 'software' zero-position; indeed, there is no sensing means to detect whatsoever the position of the pointer.

As known per se, the oscillator outputs a periodic signal, usually having a frequency above some kHz, this signal goes through one or more frequency divider(s) to result in a 1 Hz tick signal, which is used to increment the time internal counter(s). Internal counters reflecting second, minute, hour are used to control the clockwise displacement of the pointers.

Hence, the controller 14 counts the steps imparted to the stepper motor from the 'software' zero-position, and constantly keeps record of the number of steps done from the reference position, this count reflecting normally the current physical position of the pointer; in the shown example, the reference position is taken at 12:00; though another reference position can be chosen.

However, an initial step is required to 'teach' the reference position to the controller, since there is no sensor (no feedback) to sense the physical position. This is necessary after the first power-up of the watch.

Also the current position of the pointer may be lost in case of power supply disruption (change of battery or battery exhausted), especially if no non-volatile memory is available; if so, a new teaching ('calibration') is required. Even if non-volatile memory is used to save periodically the value of the internal counters, since this is time and energy consuming, the frequency of savings cannot be fast. Therefore, in case of power supply disruption, the current pointer position is different from the last saved position; in this case also, a new teaching is required.

Also, even without any problem of power supply disruption or loss of reference position, there is a risk of pointer leap or skip, for example if a shock is undergone. Also, an electromagnetic interference can prevent proper operation of the stepper motor control, causing a step loss, or a powerful spike can also trigger an inadvertent leap of the pointer without intentional control.

As a result, there may be a 'drift' of the pointer, i.e. the actual position of the pointer is different from the 'known' position from the controller standpoint.

For all these reasons, it is required to carry out a calibration, (or re-calibration) of the pointer.

Advantageously, an interaction with a smartphone 8 is performed to do so. Instead of the smartphone, a tablet, a phablet, or any graphic-and-wireless enabled device can also be used.

The calibration method comprises a first step S1, in which the calibration is initiated. The calibration phase involves a special mode at the watch 7 and an application at the smartphone 8, illustrated at FIGS. 3A, 3B, 3C and 3D. The calibration is initiated (step S1) by a special control of the smartphone or initiated by the watch itself if it can recognise that the knowledge of the position of pointers have been lost or is not known (For example after first power up).

Under the special calibration mode, the watch 7 awaits from controls to be received from the smartphone, especially motion controls, that are intended to move one of the pointer toward the ref-position. Said motion controls are issued from a user finger drag(s) on a graphic wheel 5 on the smartphone.

More precisely, there is provided a minute pointer calibration step, called step S2, in which the minute pointer 2 is caused to be moved to its ref-position (here 12h) via the graphic wheel interface 5 on the smartphone. A finger 50 of the user can be dragged (touch and slide and move up on the tactile surface) in the circumferential direction of the wheel, either in the clockwise direction 51 or in the counterclockwise direction 52.

Via the wireless communication link, correspondent motion controls are sent from the smartphone to the watch. The controller 14 of the watch transforms said motion controls into relevant control signals issued to the second stepper motor 32, so that the minute pointer 2 is angularly moved in a direction consistent with the finger 50 drag. Namely a clockwise drag 51 will cause the minute pointer 2 to be moved in the clockwise direction 81. Conversely, a counterclockwise drag 52 will cause the minute pointer 2 to be moved in the counterclockwise direction 82.

Motion controls may be defined as angular displacements, in correspondence with the drag operation(s), especially the distance travelled by the drag, and optionally also the speed of the drag.

Figure 6:
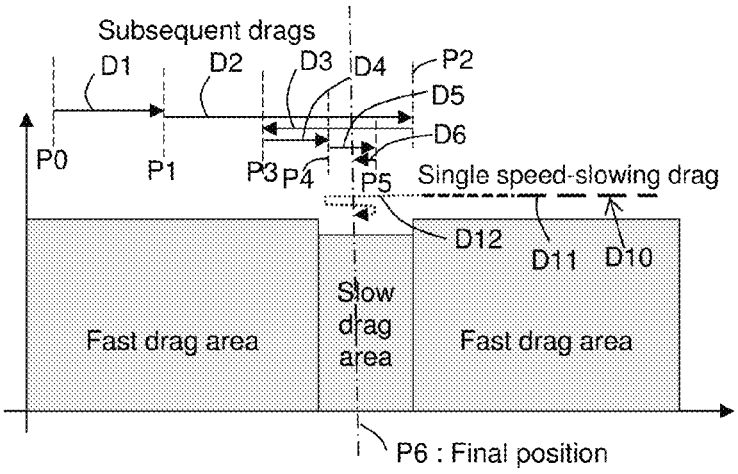
FIG. 6 shows a chart relative to the pointer movement management.

There may be several subsequent movements, corresponding to several subsequent distinct finger drags, as illustrated at left in FIG. 6. According to this example, at the beginning of the calibration phase for one pointer, the pointer is at position P0, a first drag D1 causes the move to position P1, a second drag D2 causes the move to position P2, a third drag D3 causes the move to position P3, a fourth drag D4 causes the move to position P4, a fifth drag D5 causes the move to position P5, a sixth drag D6 causes the move to the final position P6.

Alternately, there may be a single speed-changing finger drag D10, as illustrated in dotted line at right in FIG. 6. The beginning D11 of the drag movement is fast and then the drag slows down D12 at the vicinity of the target ref-position.

Advantageously, the magnitude of the pointer angular displacement in response to a given drag operation may depend on the speed of finger drag. More precisely, the 'transfer gain' from the finger drag travel to the pointer travel may be decreased upon slower drag movement and/or the occurrence of back-and-forth movement. This gain adjustment allows the user to perform a fine tuning of the alignment of pointer with the reference position.

Note that when a decreased gain prevails, a new fast finger drag will re-establish the standard gain.

When the alignment of the pointer with the reference position is considered satisfactory by the user, the user validates the calibration of this pointer; therefrom a validation message is sent to the watch. The controller 14 thereby assumes that the current pointer is exactly at the reference position and is therefore known.

As seen from FIGS. 3A, 3B, 3C and 3D, the pointer calibration is an intuitive and self-explaining interface.

After the minute pointer, the next step is carried on with the hour pointer 1 the same way. The hour pointer calibration phase, called step S3, is similar to the minute pointer calibration and will not be repeated again here.

After the hour pointer, the next optional step ('S31') is to carry on with the third pointer 3 the same way. If the seconds pointer 4 is present, a similar calibration step ('S32') can also be carried out.

When the whole calibration process is finished from the user standpoint, the user issues a termination control on the smartphone application, which is denoted step S4.

Therefrom a termination message is sent from the smartphone to the watch. The controller 14 thereby terminates the special calibration mode. After termination of the special calibration mode, the watch has to return to the standard time display, and therefore there may occur substantial movements of pointers so that they reach the respective positions indicating the current time stored in the memory of the controller.

Figure 7:
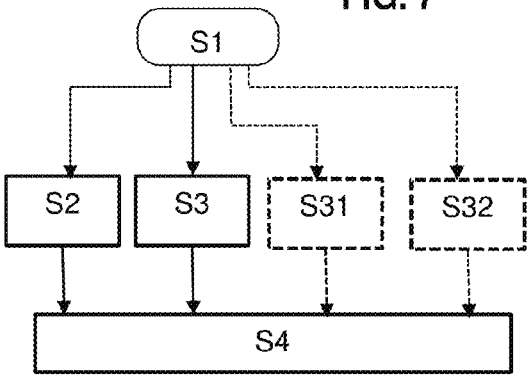
FIG. 7 illustrates an exemplary state-chart of the disclosed method.

The above mentioned steps of the method are illustrated at FIG. 7.

It should be noted that during calibration phase, the movement of the pointer is in real-time correspondence with the finger drag (no substantial time lag).

Figure 5A:
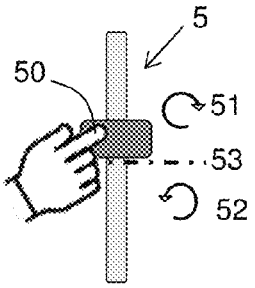
Figure 5B:
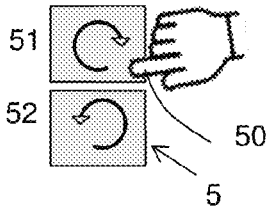

As shown in FIGS. 5A and 5B, there may be provided various alternatives to the wheel-type value setting interface. At FIG. 5A, a virtual joystick has a neutral position 53, a resilient clockwise control position 51, a resilient counter-clockwise control position 52, the movement speed may be dependent on the current deviation from the neutral position 53. At FIG. 5B, there are provided a clockwise control button 51, a counter-clockwise control button 52, the movement speed may be dependent on the duration spent on one of said buttons.

Also regarding reference positions, instead of 12:00, ref-positions can be located elsewhere in the dial. For example, the first and second ref-positions could correspond to 3:45 ('horizontal' line).

Regarding now the battery 16, the battery can be a conventional battery or rechargeable battery. The recharge of the battery can result from photovoltaic cells on the cover window 71. Another possible embodiment uses the Seebeck effect, and a temperature difference between this skin of the user and housing 70 of the watch 7.

The invention claimed is:

1. An interaction method between on the one hand a graphic tactile device and on the other hand a timepiece having at least two analog-type physical pointers, among which are an hour pointer and a minute pointer, each being controlled independently by a stepper motor and each referenced respectively relative to a first and second ref-position, the timepiece comprising a control unit configured to handle time count and to control stepper motors, the timepiece being deprived of any time set button/actuator, the graphic tactile device having a value setting interface, the timepiece and the graphic tactile device being able to be in communication through a wireless remote short-range communication link, the method comprising the steps:

initiating a calibration procedure, causing the minute pointer to be moved to the first ref-position via the value setting interface, causing the hour pointer to be moved to the second ref-position via the value setting interface, ending the calibration procedure, and return to a normal time display, which causes the control unit of the timepiece to know accurately the positions of pointers, wherein the value setting interface comprises a graphic object, wherein at when causing the minute pointer to be moved to the first-ref position via the value setting interface, or at when causing the hour pointer to be moved to the second-ref position via the value setting interface, a movement of a pointer is performed in response to a drag travel on the graphic object by the finger of a user, and wherein at when causing the minute pointer to be moved to the first-ref position via the value setting interface, or at when causing the hour pointer to be moved to the second-ref position via the value setting interface, there is defined a transfer gain from the finger drag travel to the pointer angular travel, and there is defined a speed of the finger drag, wherein the transfer gain is adjusted and updated in response to the speed of the finger drag.

2. The interaction method of claim 1, wherein the graphic tactile device is a smartphone.

3. The interaction method of claim 1, wherein the timepiece is a wristwatch with hour pointer and minute pointer arranged coaxially.

4. The interaction method of claim 1, in which during the first ref-position is the top position, namely '12h' position, the second ref-position is the same top position.

5. The interaction method of claim 1, wherein the graphic object is formed as a wheel graphic object.

6. The interaction method of claim 1, wherein the timepiece comprises a third pointer, further comprising:

causing the third pointer to be moved to a specific ref-position via the value setting interface.

7. The interaction method of claim 1, wherein the timepiece comprises a auxiliary pointer for seconds, ("seconds" pointer), further comprising:

causing the auxiliary pointer to be moved to another ref-position via the value setting interface.

8. A timepiece having at least two analog-type pointers, among which are an hour pointer and a minute pointer, each of the pointers being controlled independently by a stepper motor and referenced respectively relative to a first and a second ref-position, said timepiece being deprived of any manual user input to set the time, and being deprived of any tactile screen functionality, said timepiece being able to communicate through a wireless short-range communication, with a remote graphic tactile device, wherein the timepiece is configured to, under a calibration procedure:

move the minute pointer upon receiving a first motion control from the remote graphic tactile device, enabling the user to cause the minute pointer to move toward the second ref-position, and move the hour pointer upon receiving a second motion control from the remote graphic tactile device, enabling the user to cause the hour pointer to move toward the first ref-position, whereby the calibration procedure is performed through a user interaction with the remote graphic tactile device, and wherein the received first motion control and the received second motion control each define one or more user finger drags on a value setting interface of the remote graphic tactile device, such that a respective magnitude of angular displacement of the moved hour pointer and the moved minute pointer is based on the speed of the respective one or more user finger drags.

9. The timepiece of claim 8, having a water-tightness level of at least IP68.

* * * * *